United States Patent [19]

Wright

[11] Patent Number: 4,796,885

[45] Date of Patent: Jan. 10, 1989

[54] INSERT FOR BATTING TEE AND METHOD OF REPAIRING A BATTING TEE

[76] Inventor: Robert L. Wright, 4221 75th St., Des Moines, Iowa 50322

[21] Appl. No.: 874,508

[22] Filed: Jun. 16, 1986

[51] Int. Cl.[4] ..... A63B 69/40

[52] U.S. Cl. ..... 273/26 R; 52/514; 29/450; 29/402.09; 273/25

[58] Field of Search ..... 52/514, 518; 273/25, 273/26 R, 75, 81 R, 81.2; 405/250; 285/15; 138/97; 29/402.09, 450, 451; 156/196; 215/33, 34, 35, 216, 227, 246, 247, 249, 250, 272, 317, 355, 353

[56] References Cited

U.S. PATENT DOCUMENTS

| | | | |
|---|---|---|---|
| 2,704,100 | 3/1955 | Freeman | 215/355 |
| 3,436,880 | 4/1969 | Kifer | 52/58 |
| 3,858,878 | 1/1975 | Tassone | 273/202 |
| 4,185,375 | 1/1980 | Brown | 273/75 |

FOREIGN PATENT DOCUMENTS

| | | | |
|---|---|---|---|
| 993831 | 7/1951 | France | 215/355 |

*Primary Examiner*—Richard C. Pinkham
*Assistant Examiner*—T. Brown
*Attorney, Agent, or Firm*—Zarley, McKee, Thomte, Voorhees & Sease

[57] ABSTRACT

The upper post section of a batting tee is strengthened and/or repaired by a solid plug being positioned in the open upper end and a sleeve initially rolled up is unrolled downwardly and around the post upper end.

3 Claims, 1 Drawing Sheet

44
10
40
36
38
32
30
11
50
28
52
26
34
24
22
14
16
18
20
12

INSERT FOR BATTING TEE AND METHOD OF REPAIRING A BATTING TEE

BACKGROUND OF THE INVENTION

Typical batting tees have a very short life due to damage caused by the ball bat hitting the top of the tee. The post is cylindrical and hollow and the sidewall easily cracks under the stress of being repeatedly hit by a ball bat. Heretofore the only recourse would be to replace the upper section of the tee post supporting the ball. This becomes a very expensive practice.

SUMMARY OF THE INVENTION

This invention provides a method of strenthening new tees and repairing damaged tees. The invention also involves an insert unit which includes a solid plug which fits into the upper open end of the tee post and a sleeve connected to the upper end of the post is adapted to roll down around the post peripheral wall. The post wall is then snugly held between the solid insert and the sleeve and protected against any further damage from bat impact. The insert plug is first inserted into the open end of the post and the sleeve which is in a rolled up condition on the end of the plug is then rolled down to a substantially coextensive length with the plug. The ball now is supported by the insert at the juncture of the sleeve with the plug. The plug includes a recessed area to receive the ball. The wall of the post is now protected on its outside as well as its inside surfaces and becomes substantially more solid and unitary.

DESCRIPTION OF THE PREFERRED EMBODIMENT

Figures 1, 2, 3, 4:
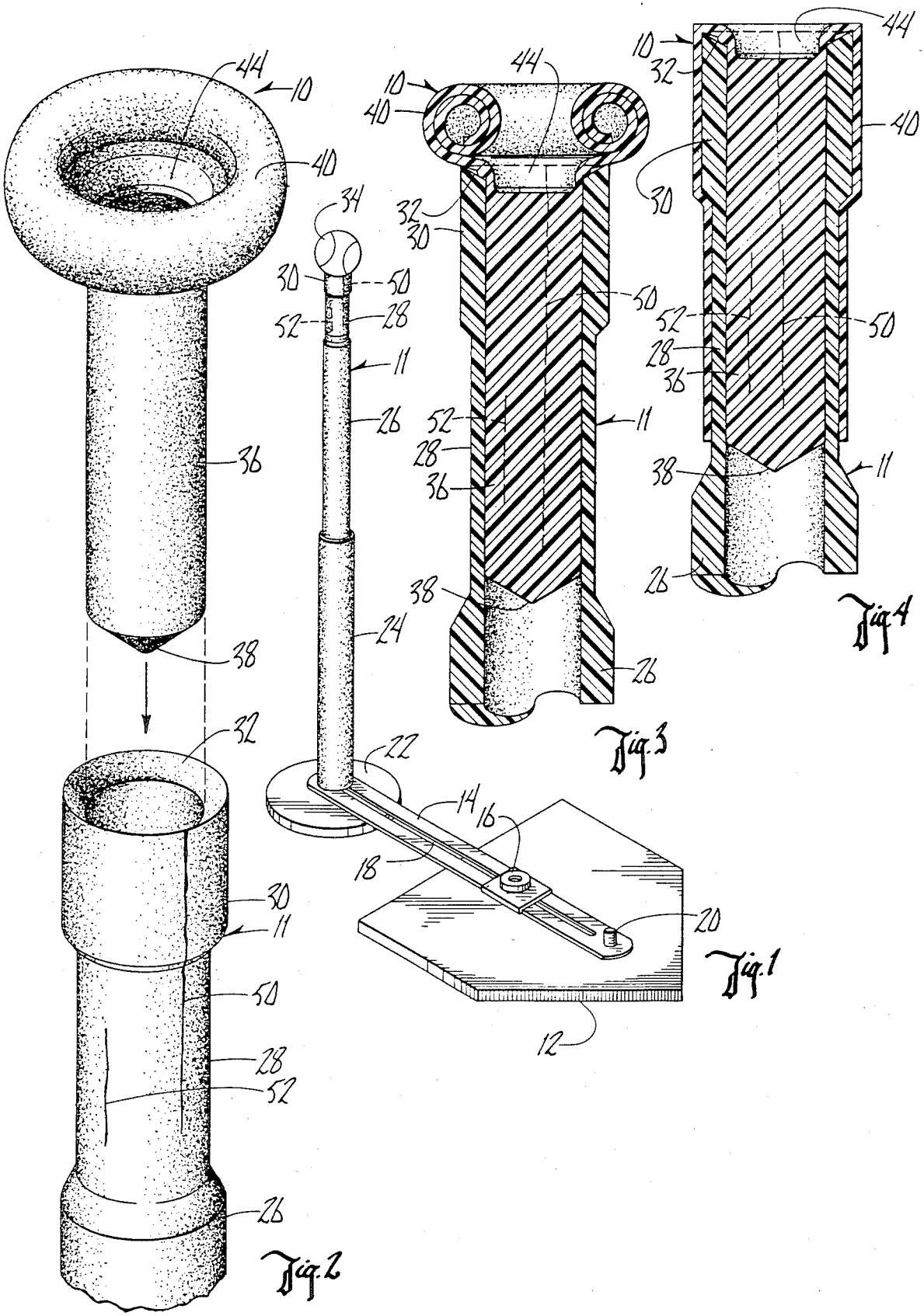
FIG. 1 is a perspective view of a batting tee showing the insert of this invention in use.
FIG. 2 is an enlarged fragmentary exploded view of the post ready to receive the insert.
FIG. 3 is an enlarged fragmentary cross-sectional view of the insert positioned in the tee post prior to the sleeve being rolled into its position of use.
FIG. 4 is a view similar to FIG. 3 showing the sleeve rolled down into its position of use.

The insert of this invention is referred to generally in FIG. 2 by the reference numeral 10 and is shown in FIG. 1 in use on a batting tee 11.

The batting tee 11 includes a home plate 12 to which an arm 14 is pivotally connected by a fastener 16 extending through a slot 18 which allows the arm to be extended at any desired length and angle relative to the plate 12. A fastener 20 on the end of the arm 14 may be utilized which would fix the length of the arm relative to the plate 12. A second plate 22 is positioned on the outer end of the arm 14 and supports a post comprised of a lower post section 24 which telescopically receives an upper post section 26. The upper post section 26 includes a reduced in diameter portion 28 which merges at its upper end in a portion 30 having a diameter and wall thickness corresponding to the post below the portion 28. A recessed concave upwardly facing surface 32 is provided in the open upper end to receive a ball 34.

The insert of this invention 10 includes a solid plug 36 having a lower pointed end 38 which is received into the open end of the upper post section 26, as seen in FIG. 2. Integral with the upper end of the insert 36 is a rolled up sleeve 40 which is rolled down along the length of the upper post section 26 to a substantially coextensive position with the plug 36, as seen in FIG. 4. The post and the insert are made of rubber material with the insert sleeve 40 having an elastic quality to it such that it snugly fits around the post wall and unifies it with the plug 36 to provide a unitary upper post end for supporting the ball 34 and resisting damage upon impact from a bat when attempting to strike the ball 34.

As seen in FIG. 4, a recess 44 is provided at the juncture of the plug 36 with the sleeve 40 to support the ball 34 (not shown).

As further seen in the drawings, the upper post (without the insert 10), after use, may include cracks 50 and 52 which, if not repaired, will quickly enlarge and destroy the usefulness of the upper post section by rendering the post unable to any longer support a ball 34. The use of the insert 10 clamps the wall of the upper post section 26 tightly between the sleeve 40 and the plug 36 thereby preventing any further enlargement of the cracks or the creation of any additional new cracks.

It is thus seen in operation that as original equipment the upper post section 26 may include the insert 10 or a damaged upper post section 26 may be repaired by the use of the insert 10 after cracks 50 and 52 have developed. The use of the insert after the cracks are present may very well extend the life of the post comparable to a new post having the insert 10. It is believed that the use of the insert 10 will extend the life of the typical batting tee from perhaps several weeks to several years.

What is claimed is:

1. A batting tee comprising, an upstanding post having a hollow upper post section adapted to hold a ball on the upper end thereof, and an insert unit including a substantially solid plug positioned in the hollow upper end of said upper post section to strengthen and rigidify said post against damage from impact from ball bats striking balls held by the upper end of said upper post section, and said insert unit including at its upper end a sleeve extending downwardly and outwardly around the outer end of said upper post section.

2. The structure of claim 1 wherein said insert unit is made of a rubber material.

3. The method of repairing a damaged batting tee post wherein said post is tubular and hollow, comprising the steps of, taking an insert unit including a solid elongated plug having a rolled up sleeve on one end, inserting the solid plug into the open top end of the hollow tubular post, and rolling the sleeve downwardly around said post to provide a unitary strengthened substantially solid post.

* * * * *